US005868118A

United States Patent [19]

Yoshioka

[11] Patent Number: 5,868,118

[45] Date of Patent: Feb. 9, 1999

[54] FUEL-INJECTION CONTROL DEVICE FOR OUTBOARD MOTORS FOR LOW-SPEED OPERATION

[75] Inventor: Hidehiko Yoshioka, Shizuoka-ken, Japan

[73] Assignee: Suzuki Motor Corporation, Japan

[21] Appl. No.: 816,657

[22] Filed: Mar. 13, 1997

[30] Foreign Application Priority Data

Mar. 26, 1996 [JP] Japan ..... 8-069767
Mar. 26, 1996 [JP] Japan ..... 8-069769

[51] Int. Cl.[6] ..... F02D 41/04

[52] U.S. Cl. ..... 123/494; 123/480; 440/1

[58] Field of Search ..... 123/494, 480, 123/478; 440/1

[56] References Cited

U.S. PATENT DOCUMENTS 5,073,133 12/1991 Inoue ..... 440/1

OTHER PUBLICATIONS

Patent Abstracts of Japan, abstract for JP 8–226347 (Hashimoto), Sep. 3, 1996.

*Primary Examiner*—Andrew M. Dolinar
*Attorney, Agent, or Firm*—Morrison Law Firm

[57] ABSTRACT

A fuel injection control device for outboard motors optimizes the air-fuel ratio when trim is applied to the outboard motor, especially those with two-cycle engines. In such an outboard motor, engine speed, throttle setting, engine boost pressure, engine temperature, intake air temperature, and/or other variables are detected and a basic fuel injection volume determined. Fuel is supplied to each of the engine's cylinders according to the detected values. A trim angle detecting means is used to indicate trim angle. During low-speed operation, the trim angle is detected, and the magnitude of a change in the trim angle is calculated. The magnitude of the change in the trim angle is used to estimate the residual fuel volume within the engine. The estimated value is used to apply correction to the basic fuel injection volume following the change in the trim angle. As a result, during low-speed operation, an optimal air-to-fuel ratio can be obtained when the trim of the outboard device is changed.

7 Claims, 10 Drawing Sheets

CORRECTION MAP BASED ON CHANGE IN TRIM ANGLE AND ENGINE ROTATION SPEED

| | TRIM ANGLE | | | | | |
|---|---|---|---|---|---|---|
| ENGINE ROTATION SPEED | C11 | C12 | C13 | C14 | C15 | ... |
| | C21 | C22 | C23 | C24 | C25 | |
| | C31 | C32 | C33 | ... | ... | |
| | C41 | C42 | ... | ... | ... | |
| | ... | ... | ... | | | |

FIG.6a

CORRECTION MAP BASED ON CHANGE IN TRIM ANGLE AND ENGINE TEMPERATURE

| | TRIM ANGLE | | | | | |
|---|---|---|---|---|---|---|
| ENGINE TEMPERATURE | C11* | C12* | C13* | C14* | C15* | ... |
| | C21* | C22* | C23* | C24* | C25* | |
| | C31* | C32* | C33* | ... | ... | |
| | C41* | C42* | ... | ... | ... | |
| | ... | ... | ... | | | |

FIG.6b

CORRECTION MAP BASED ON CHANGE IN TRIM ANGLE AND INTAKE TEMPERATURE

| | TRIM ANGLE | | | | | |
|---|---|---|---|---|---|---|
| INTAKE TEMPERATURE | C11** | C12** | C13** | C14** | C15** | ... |
| | C21** | C22** | C23** | C24** | C25** | |
| | C31** | C32** | C33** | ... | ... | |
| | C41** | C42** | ... | ... | ... | |
| | ... | ... | ... | | | |

FIG.6c

| | CHANGE IN TRIM ANGLE |
|---|---|
| | − T ... ... 0 ... ... + T |
| TAILING TIME | t1 ... ... t0 ... ... t2 |

FUEL-INJECTION CONTROL DEVICE FOR OUTBOARD MOTORS FOR LOW-SPEED OPERATION

BACKGROUND OF THE INVENTION

The present invention relates to a fuel-injection control device for outboard motors. In particular, the present invention relates to fuel-injection control for low-speed operation of an engine.

Traditional internal combustion engines use a carburetor as a means for supplying a fuel-and-air mixture into the combustion chamber. A carburetor in the suction flow path of an engine takes advantage of the air sucked in by the engine and expels fuel in a mist form from a chamber inside the carburetor. The fuel mist mixes with the air and the resulting fuel-and-air mixture is sent into the engine.

To compensate for specific engine characteristics the operating demands of the automobile or marine environment, and the characteristics of the load driven by the engine (e.g., an automobile or a boat), the carburetor uses a combination of different jet types to provide an optimal setting. However, a carburetor cannot adapt continuously to changes in driving conditions and the surrounding environment. In particular, achieving a proper setting for the air-to-fuel ratio when the engine is started or during low-speed operation is difficult.

In recent years, engines with fuel-injection devices have been widely used as an alternative to carburetors. A fuel-injection device uses as its control parameters such factors as the temperature of the engine, the temperature of the water used to cool the engine, the air suction temperature, the engine boost pressure, the engine speed, the intake air temperature, the throttle setting, and so forth. It is clear to one skilled in the art that the above list of parameters is neither exclusive nor exhaustive, and a number of other parameters may be used also or in combination with the above list as control parameters for the engine. One or more of these control parameters defines the engine state. These control parameters are analyzed using a computer to determine a correction value. A fuel injector injects an amount of fuel appropriate at that particular instant directly into the air suction path of the engine. Thus, both combustion efficiency and engine output optimized. Also, fuel consumption is minimized, since only the minimum necessary amount of fuel is injected into the engine.

In outboard motors used in small marine vessels, the engine can be pivoted (trimmed) around a shaft on an attachment bracket. This provides increased efficiency from the propeller to correspond with the orientation and speed of the marine vessel. For outboard motors using a two-cycle engine, applying trim to the outboard motor results in a fuel residue remaining on the walls of a crank chamber within the engine and the inner walls of a surge tank. When fuel is left as residue at these locations, it is possible for there to be temporarily insufficient fuel introduced into the combustion chamber of the engine until the residual fuel becomes constant relative to the incline of the outboard device. This can result in a lean air-to-fuel ratio, which is undesirable. Also, depending on the magnitude of the change in the trim angle, there can be variations in the value at which the air-to-fuel ratio becomes lean as well as variations in the time required for the air-to-fuel ratio to return to normal and stabilize (see FIG. 9(*a*) and (*b*)).

Referring to FIG. 7, a sample correction map is shown for the magnitude of the change in the trim angle and the tailing time (i.e. the stabilization of the correction with time after a change in the trim angle).

Referring to FIG. 8, a relationship is shown between the correction continuation time and the change in the trim angle (magnitude and direction).

When the outboard device is trimmed down, the residual fuel left in the engine flows into the combustion chamber all at once. When the fuel flows into the combustion chamber all at once, there is an excessive fuel supply, resulting in a richer air-to-fuel ratio, which is not desirable. Also, depending on the magnitude of the change in the trim angle, there can be variations in the value at which the air-to-fuel ratio becomes rich as well as variations in the time required for the air-to-fuel ratio to return to normal and stabilize (see FIG. 9(*c*) and (*d*)).

Referring to FIG. 10(*a*), the residual fuel left in the engine is greater when the trim angle is larger.

Also, the residual fuel volume varies according to the operating state of the engine. Referring to FIG. 10(*b*), there is a higher residual fuel volume when the engine rotation speed is lower compared to when the engine rotation speed is higher.

Referring to FIG. 10(*b*), as in engine rotation speed, a lower engine temperature results in a higher residual fuel volume compared to a higher engine temperature. Referring to FIG. 10(*d*), there is higher residual fuel volume when the intake air temperature is lower than when the intake air temperature is higher.

As described above, the volume of residual fuel varies according to the operating state of the engine. In particular, residual fuel volume is high when the engine is operated at low speeds.

The use of corrections based on the trim angle of the outboard device to control the fuel supply volume has been disclosed in the past, such as in Japanese laid-open publication number 2-283833 and Japanese laid-open publication number 6-66177. In these references the fuel supply volume is corrected based solely on the trim angle of the outboard device, and no consideration is given to changes in the trim angle and the operating state of the engine. When the fuel supply volume is corrected based solely on considering the trim angle, the fuel can be too rich or too lean so that an appropriate air-to-fuel ratio cannot be obtained. This can result in white smoke in the exhaust gas and increased engine vibrations (when the air-to-fuel ratio is too rich), or in sudden engine stoppage (stall) (when the air-to-fuel ratio is too rich or too lean).

OBJECTS AND SUMMARY OF THE INVENTION

The object of the present invention is to overcome the problems of the references cited above and to provide a fuel injection control device for outboard devices that optimize the fuel-to-air ratio when trim is applied to the outboard device.

Briefly, a fuel injection control device for outboard motors optimizes the air-fuel ratio when trim is applied to the outboard motor, especially those with two-cycle engines. In such an outboard motor, engine speed, throttle setting, engine boost pressure, engine temperature, intake air temperature, and/or other variables are detected and a basic fuel injection volume determined. Fuel is supplied to each of the engine's cylinders according to the detected values. A trim angle detecting means is used to indicate trim angle. During low-speed operation, the trim angle is detected, and the magnitude of a change in the trim angle is calculated. The magnitude of the change in the trim angle is used to estimate the residual fuel volume within the engine. The estimated value is used to apply correction to the basic fuel injection volume following the change in the trim angle. As a result, during low-speed operation, an optimal air-to-fuel ratio can be obtained when the trim of the outboard device is changed.

According to an embodiment of the present invention there is provided, a fuel injection control device for an outboard motor with a fuel-injected engine comprising: a main control unit, an engine state detector connected to apply an engine state signal to the main control unit, a trim angle detector connected to detect a trim angle of the outboard motor, the trim angle detector being connected to apply a trim angle detection signal to the main control unit, the main control unit being programmed to control delivery of fuel to the fuel injected engine responsively to a change in the trim angle detection signal and at least one of the engine state signal and the trim angle detection signal.

According to another embodiment of the present invention, there is provided, a method for controlling fuel flow rate to an outboard motor having a fuel injected engine, comprising the steps of: measuring an engine state of the fuel injected engine, measuring a trim angle of the fuel injected engine, controlling a rate of fuel delivery to the fuel injected engine responsively to the engine state, the trim angle of the fuel injected engine, and a change in the trim angle of the fuel injected engine.

According to still another embodiment of the present invention, there is provided, a device for controlling power output of a marine fuel injected engine comprising: a control circuit including means for controlling the fuel injected engine, a means for estimating an engine state connected to the control circuit and having means for applying a signal proportional to an engine state to the control circuit, a means for gauging a trim angle of the fuel injected engine connected to the control circuit, the means for gauging including means for applying a signal proportional to the trim angle to the control circuit, a means for detecting a change in the trim angle of the fuel injected engine capable of generating a signal proportional to the change and applying the signal to the control circuit, a means for controlling, injection of a fuel-air mix into the fuel injected engine responsively to the means for estimating the engine speed, the means for estimating the trim angle and the means for detecting a change in the trim angle.

The above, and other objects, features and advantages of the present invention will become apparent from the following description read in conjunction with the accompanying drawings, in which like reference numerals designate the same elements.

BRIEF DESCRIPTION OF THE DRAWINGS

FIG. 6(*a*), 6(*b*), and 6(*c*) are sample correction maps used for estimating the residual fuel volume within the engine.

DETAILED DESCRIPTION OF THE PREFERRED EMBODIMENTS

Figure 1:
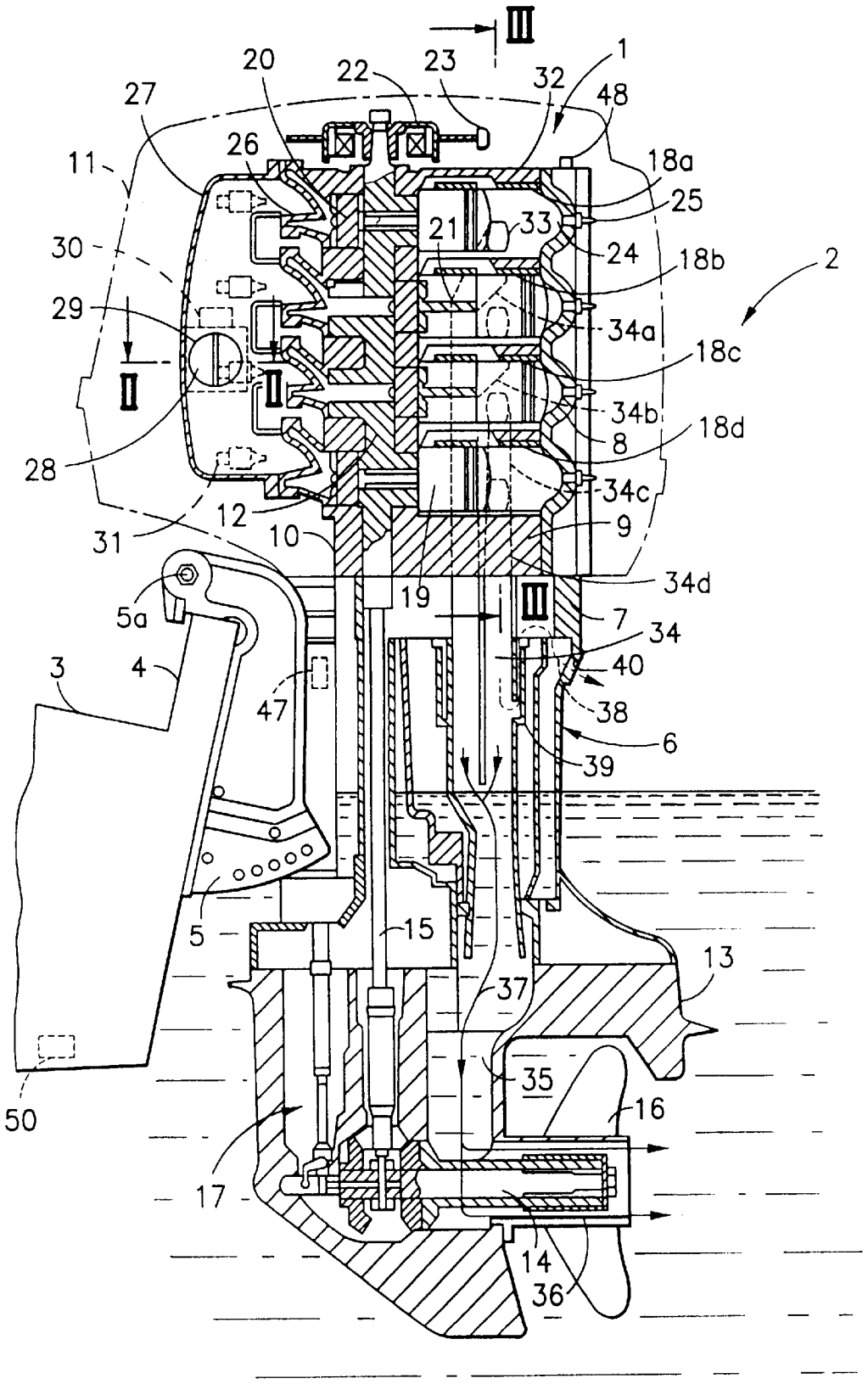
FIG. 1 is a vertical cross-section of an outboard device showing an embodiment of the fuel-injection control device for outboard devices according to the present invention.

Referring to FIG. 1, the present invention is implemented in an example of an outboard motor 2 equipped with a fuel-injected engine 1. Outboard motor 2 is mounted via a bracket 5 on a transom 4 of a boat 3. Outboard motor 2 pivots on a shaft 5*a* of bracket 5 permitting a trim angle to vary in a range of approximately 20 degrees. Bracket 5 also allows outboard motor 2 to be tilted over a range of about 60 degrees upward beyond the full trim position. The trim angle and the tilt angle are controlled through oil pressure by a power trim and tilt device (hereinafter referred to as PTT—not shown in the drawing). A PTT operations sensor 47 is disposed on the PTT which detects the current trim and tilt conditions.

Outboard motor 2 has a dry shaft housing 6. An engine holder 7 is located on an upper portion of drive shaft housing 6. An engine 1 is located above engine holder 7. Engine 1 includes a cylinder head 8, a cylinder block 9, a crank case 10, and other conventional elements. Engine 1 is covered by an engine cover 11. A vertical crank shaft 12 rotates within crank case 10. Engine 1 could be, for example, a cold-water two-cycle or four-cylinder engine.

Below drive shaft housing 6 a gear case 13 rotatably supports a propeller shaft 14 driven by engine 1. Torque from engine 1 is transmitted through crank shaft 12 to drive shaft 15. Drive shaft 15 in turn rotates propeller shaft 14, causing a propeller 16, on a rear end portion of propeller shaft 14, to rotate. A shaft mechanism 17 near a front end portion of propeller shaft 14 allows remote control of the direction of rotation of propeller shaft 14.

A first, second, third, and fourth cylinders 18*a*–18*d* are formed in cylinder block 9 of engine 1, arranged with first cylinder 18*a* at the top and cylinder 18*d* at the bottom. Pistons 19, slidable in cylinders 18*a*–18*d*, are connected to crank pins 20 of crank shafts 12 via connecting rods 21. Thus, reciprocating movements of pistons 19 are converted into a rotating motion of crank shaft 12.

A magnet 22 is disposed on an upper end of crank shaft 12. An engine rotation speed sensor 23 fixedly mounted adjacent magnet 22. Engine rotation speed sensor 23 detects the rotation speed (the crank angle of crank shaft 12) of engine 1 by detecting the rotation of magnet 22. An engine temperature sensor 48 on engine 1 detects engine temperature. A cooling water temperature sensor (not shown in the drawing) detects the temperature of the engine cooling water. A spark plug 25 is held partly in a central portion of combustion chamber 24 by threads. Spark plug 25 is fired by an ignition coil 46 to which it is connected.

Figure 2:
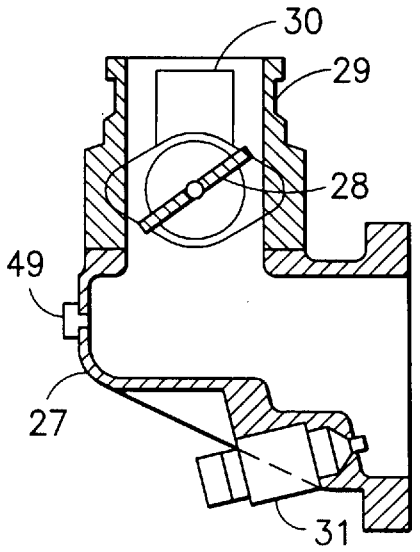
FIG. 2 is a cross-section drawing along the II—II line in FIG. 1.
Figure 3:
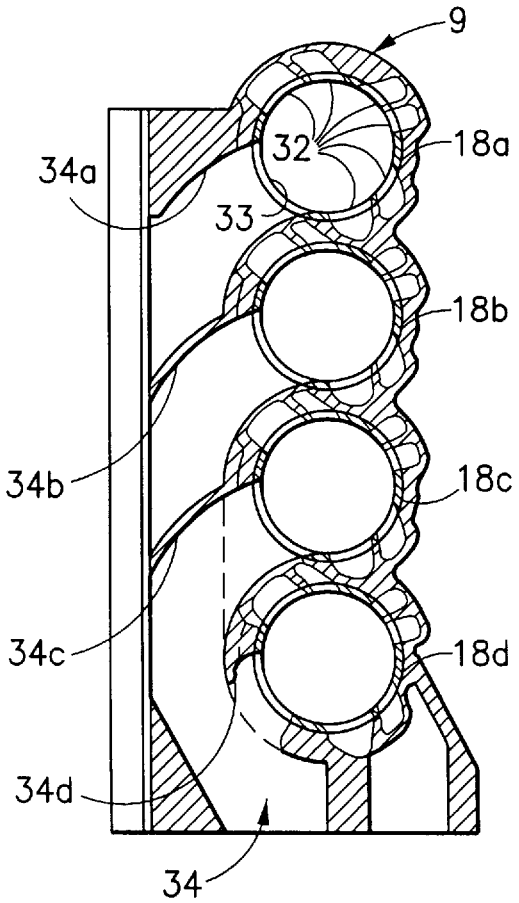
FIG. 3 is a cross-section drawing along the III—III line in FIG. 1.

Referring now also to FIGS. 2 and 3, there is one lead valve device 26, in crank case 10, for each cylinder 18*a*–18*d*. Upstream from lead valve devices 26 is a surge tank 27, and further upstream of surge tank 27 is an inlet pipe 29 with a throttle 28. A throttle setting sensor 30, which detects a setting of throttle 28, is positioned outside inlet pipe 29. An air cleaner (not shown in the drawings) is located further upstream of inlet pipe 29.

Fuel injectors 31 extend from outside surge tank 27 to its interior. In the present embodiment, there is one fuel injector 31 for each of cylinders 18*a*–18*d*. In alternative embodiments, there can be more or less. In the present embodiment, fuel injectors 31 are positioned to inject fuel upstream from lead valves 26. An inlet temperature detector 49 mounted in surge tank 27 detects inlet temperature at a crank chamber 10*a* located upstream within crank case 10. A suction pressure sensor (not shown in the drawings) detects suction pressure. An air volume sensor, an atmospheric pressure sensor, and other sensors are employed as taught by the references cited above.

Lead valve devices 26 are connected downstream of crank chamber 10*a*. Scavenging ports 32 are formed in cylinder block 9. Scavenging ports 32 open along an inner perimeter surface of each of cylinders 18. An exhaust port 33 is also formed along the inner perimeter surface of cylinder 18. An exhaust path 34 extends from exhaust port 33.

A first exhaust path 34a of first cylinder 18*a* joins with a second exhaust path 34*b* from second cylinder 34*b* and extends to roughly the center of drive shaft housing 6. Similarly, a third exhaust path 34*c* of third cylinder 18*c* joins with a fourth exhaust path 34*d* of fourth cylinder 18*d* and extends to roughly the center of drive shaft housing 6, where they join with first and second exhaust paths 34*a* and 34*b*. The end of a combined exhaust path 34 opens up to an exhaust chamber 35 within gear case 13. Exhaust chamber 35 connects to a final exhaust path 36 formed around propeller shaft 14.

The lower half of drive shaft housing 6 and gear case 13 are submerged under water. When engine 1 is stopped, the lower half of the exhaust path, exhaust chamber 35, and final exhaust path 36 are filled with water. When engine 1 is operated, this water is pressed downward by the exhaust pressure from the exhaust gas. Referring to FIG. 1. exhaust gas is sent to the water as indicated by arrows 37 (shown as solid lines). When the engine is being idled or when the engine is being run at a slow speed, the exhaust pressure is not high enough to adequately push the water downward. In such cases, the exhaust gas is evacuated to the atmosphere through a secondary exhaust opening 40 via a bypass path 39 formed in drive shaft housing 6, as indicated by arrows 38 (shown as dotted lines).

Figure 4:
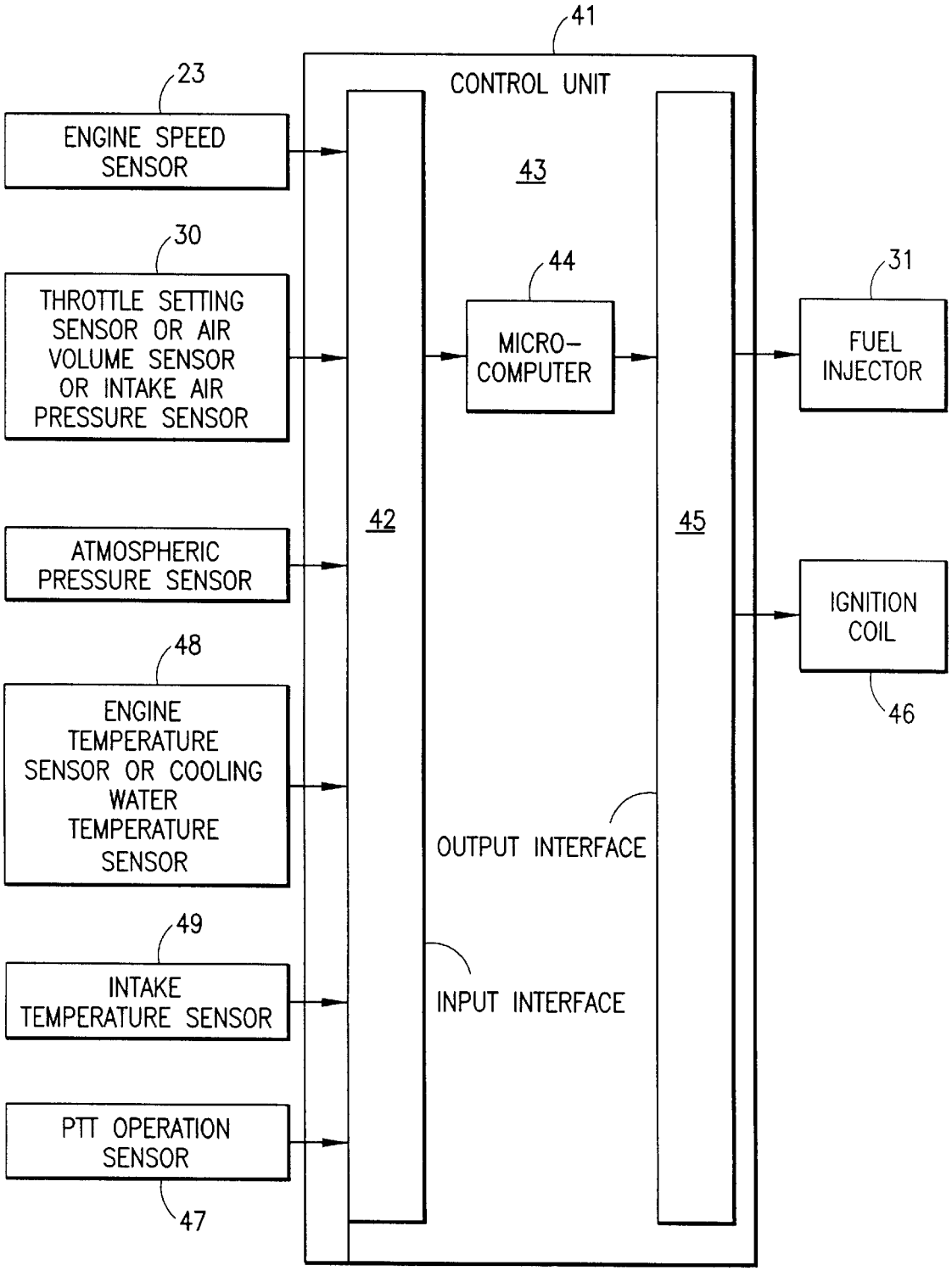
FIG. 4 is a block diagram of the fuel-injection control device.

The amount of injected fuel from fuel injector 31 is controlled by fuel injection control device 41. Referring to FIG. 4, fuel injection control device 41 detects the following with the corresponding sensors: rotation speed of engine 1, setting of throttle 28, suction pressure in surge tank 27, air volume, atmospheric pressure, engine temperature, cooling water temperature, temperature of intake air, and various conventional parameters. This data passed to a control unit 43 via an input interface 42 to which signals are applied. A microcomputer 44 within control unit 43 calculates a suction volume based on the input data. After performing various corrections, the amount of fuel to be injected and the ignition timing is calculated. This is then output to fuel injector 31 and ignition coil 46 via an output interface 45.

Referring again to FIG. 1, outboard motor 2 can be pivoted up and down (trim and tilt) by the PTT. As trim applied to outboard motor 2 is changed, the load on engine 1 varies. This variation in the load can result in varying rotation speeds for the engine even if the throttle setting is fixed. In turn, this variation in rotation speed can change engine output. Thus, it is possible to use data from the PTT operation sensor 47 on the PTT in the calculations for the amount of fuel injection.

When trim is applied to outboard device 2 comprising a two-cycle engine, fuel can remain as residue adhering to the inner wall of crank chamber 10*a* and the inner wall of surge tank 27. The residual fuel volume within engine 1 is greater when the trim angle is large. When fuel is left in engine 1, the air-to-fuel ratio may change due to insufficient fuel introduced to combustion chamber 24 in engine 1.

In outboard device 2 comprising a two-cycle engine, increasing the trim can result in residual fuel being left in engine 1 adhesed to the inner walls of crank chamber 10*a* and the inner walls of surge tank 27. Also, decreasing the trim can result in the residual fuel left in engine 1 flowing into combustion chamber 24 all at once. The residual fuel volume in engine 1 is greater when the trim angle is higher.

When residual fuel is left in engine 1, the air-to-fuel ratio becomes temporarily leaner due to insufficient fuel introduced in combustion chamber 24 of engine 1. Also, the value at which the air-to-fuel ratio becomes lean and the time required for the air-to-fuel ratio to return to normal and stabilize varies according to the magnitude of the change in the trim angle.

When the fuel left in engine 1 flows into combustion chamber 24 all at once, there is an excess fuel supply, and the air-to-fuel ratio becomes richer. Also, the value at which the air-to-fuel ratio becomes rich and the time required for the air-to-fuel ratio to return to normal and stabilize varies according to the magnitude of the change in the trim angle.

Furthermore, the volume of residual fuel varies according to the operating state of engine 1. For example, when the rotation speed of engine 1 is lower, the residual fuel volume is greater than when the rotation speed is higher. Also, as in the case of engine rotation speed, when the temperature of engine 1 is lower, the residual fuel volume is greater than when the temperature is higher. Likewise, when the intake air temperature is lower, the residual fuel volume is greater than when the intake air temperature is higher.

As described above, the air-to-fuel ratio varies greatly according to the trim angle and the magnitude in change of the trim angle. Also, the residual fuel volume varies according to the operating state of engine 1. In particular, low-speed operation of engine 1 results in greater residual fuel volume.

Figure 5:
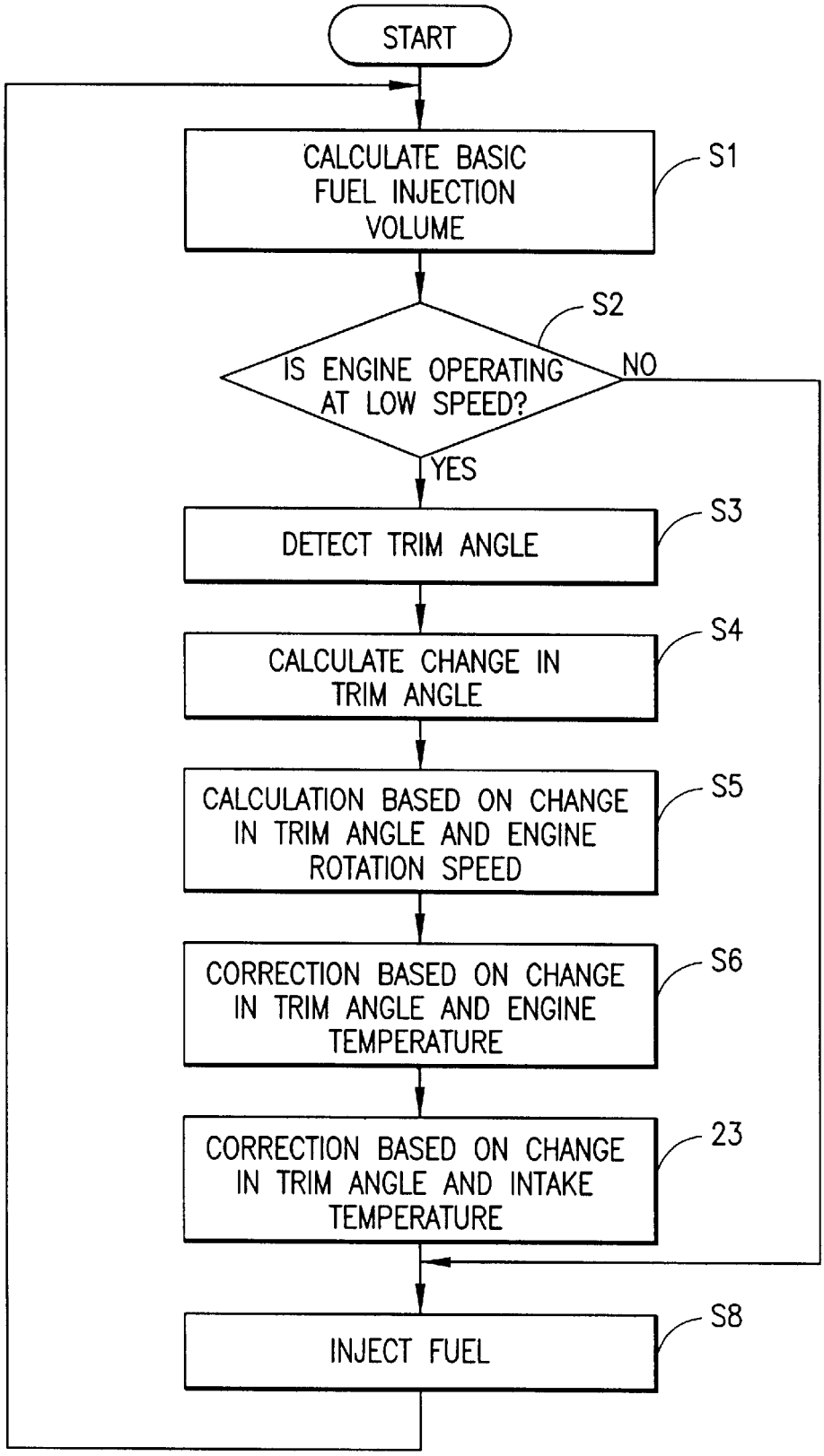
FIG. 5 is a flow chart of the main routine showing the flow of operations for fuel injection control.

Referring to the flow chart in FIG. 5, the following is a description of the flow of operations involved in fuel-injection control for low-speed operation of engine 1 in outboard device 2 according to the present invention. In this flow chart, the steps are referred to as S1, S2, etc.

Referring to FIG. 5, when engine 1 is operating, microcomputer 44 calculates an intake volume based on the various data described above. After applying various corrections, the basic fuel injection volume is calculated (S1).

Next, an evaluation is made of whether or not the engine is being operated at a low speed (S2). If not, fuel is injected into cylinder 18 of engine 1 at the basic fuel injection volume.

If it is determined that the engine is being operated at a low speed, then the trim angle is detected (S3). The change in the trim angle is then calculated (S4). The trim angle and the engine rotation speed are used to estimate the residual fuel in the engine. This estimated value is used to determine a correction value (S5). Referring to FIG. 6(*a*), there is shown a sample correction map used for determining this correction value.

Next, the trim angle and the temperature of engine 1 are used to determine the residual fuel volume within engine 1.

This estimated value is used to determine a correction value (S6). Referring to FIG. 6(*b*), there is shown a sample correction map used for determining this correction value.

Next, the trim angle and the intake air temperature are used to estimate the residual fuel volume within engine 1. This estimated value is used to determine a correction value (S6). Referring to FIG. 6(*c*), there is shown a sample correction map used for determining this correction value.

Then, the correction values obtained from steps S4–S7 are used to determine the final injection volume, and fuel is injected into cylinder 18 of engine 1 accordingly (S8).

Figures 7, 8:
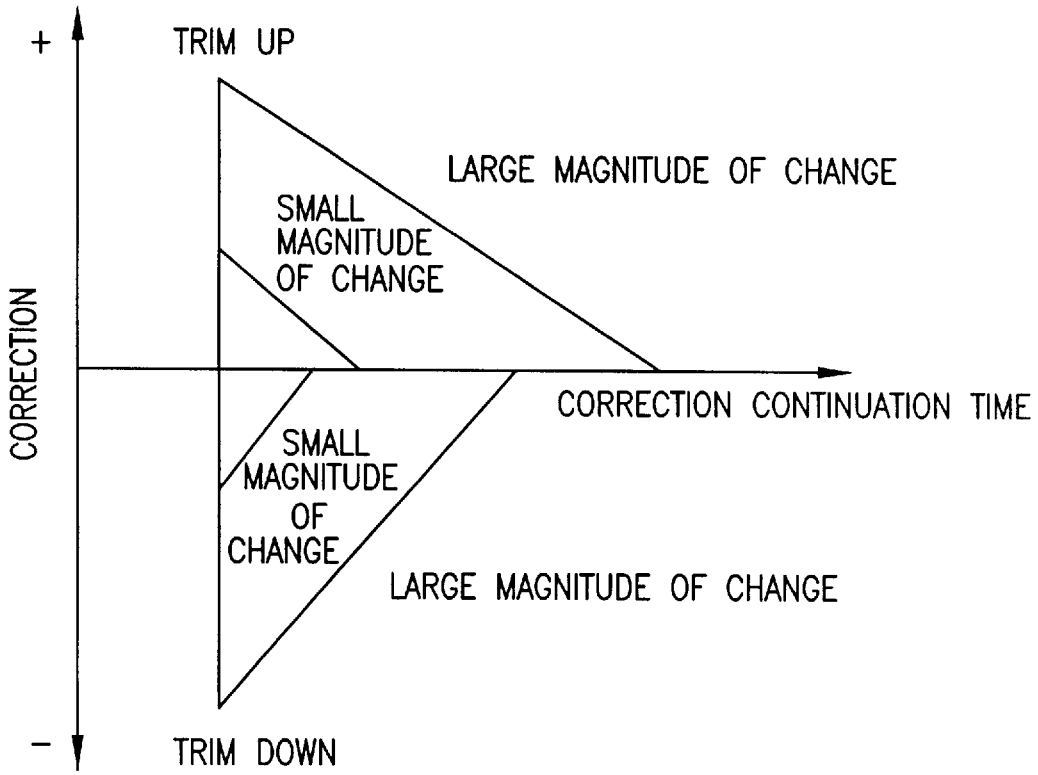
FIG. 7 is a sample correction map for the magnitude of the change in the trim angle and the tailing time.
FIG. 8 is a drawing showing the relationship between the direction of the trim angle, and the magnitude of the change in the trim angle, and the tailing time.
Figure 9A:
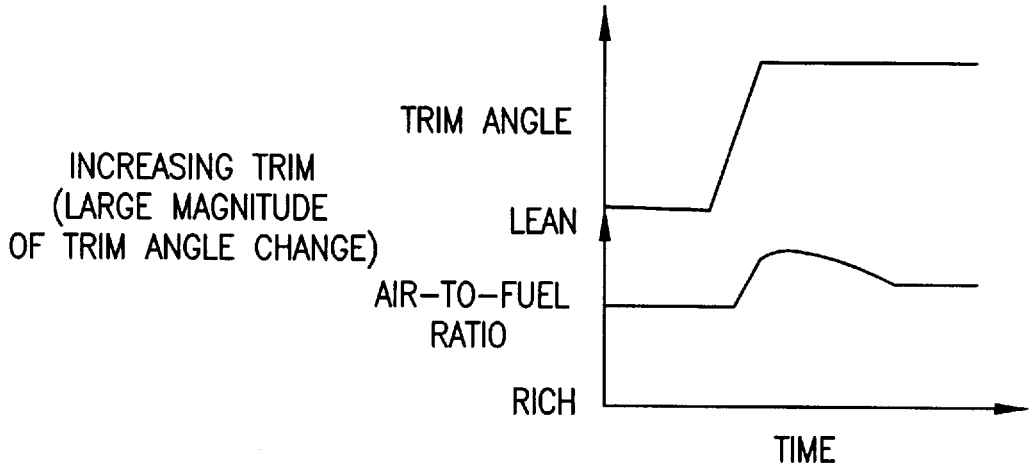
FIG. 9(*a*)–9(*d*) is a drawing showing the relationship between the magnitude of the change in the trim angle, the direction of the change in the trim angle, the richness or leanness of the air-to-fuel ratio, and the elapsed time.
Figure 9B:
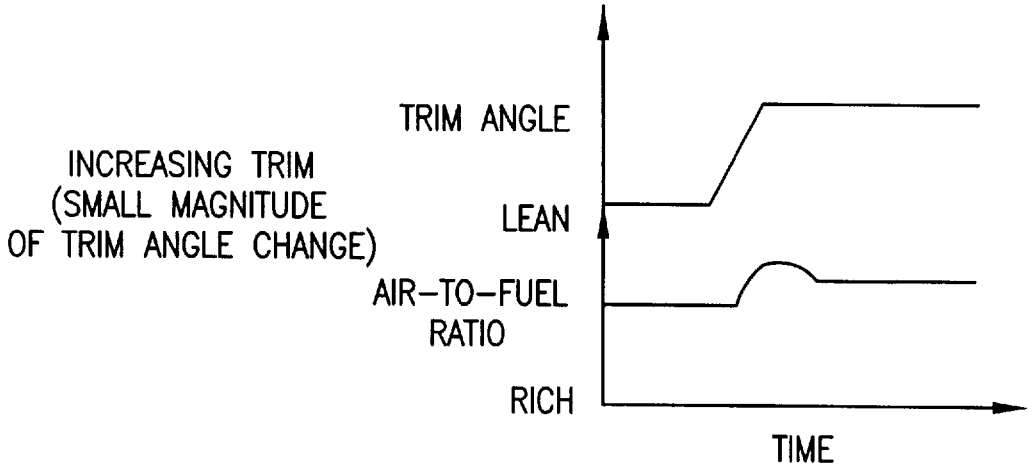
Figure 9C:
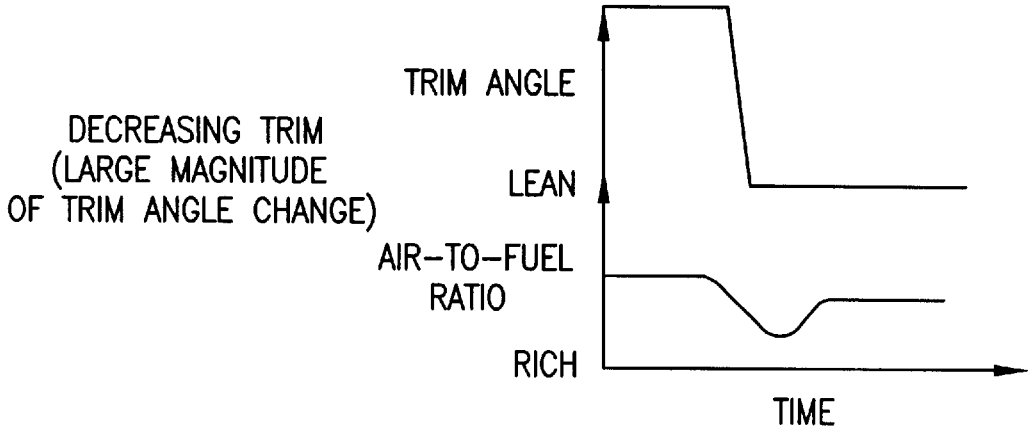
Figure 9D:
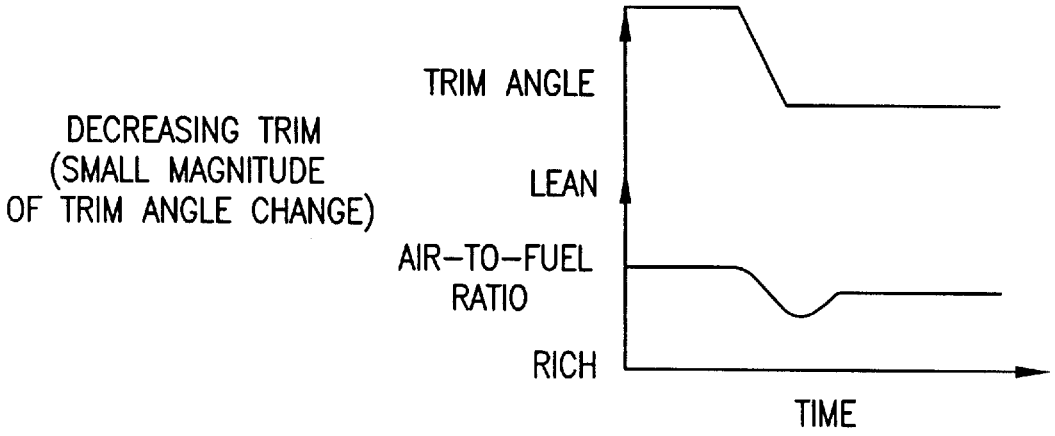
Figure 10B:
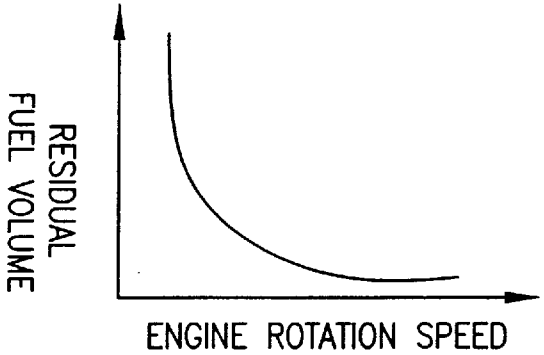
FIG. 10(*a*)–10(*d*) is a drawing showing the relationship between the residual fuel volume and the engine state.
Figure 10D:
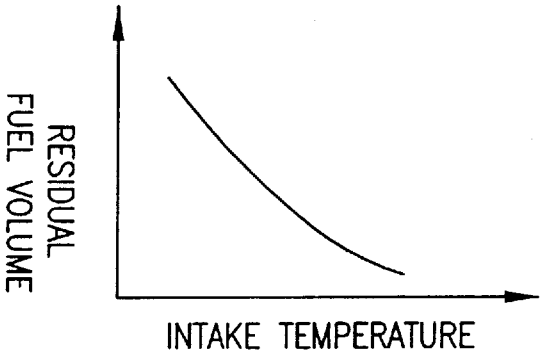
Figure 10A:
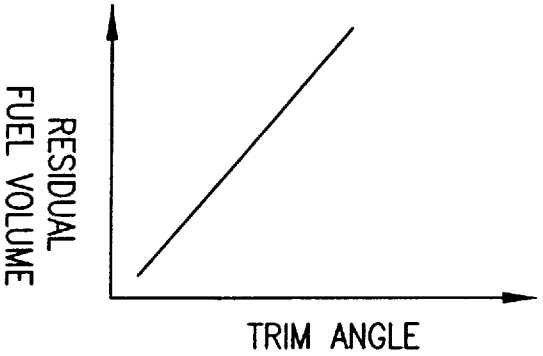
Figure 10C:
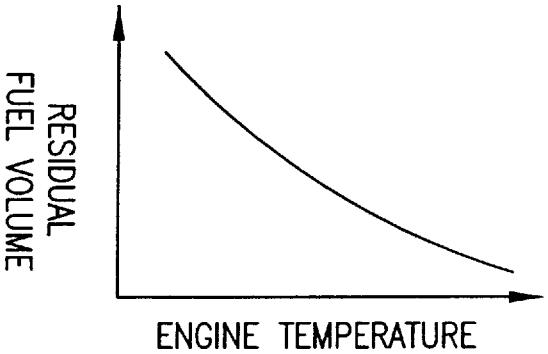

The air-to-fuel ratio, which can become richer or leaner when the trim angle is changed, tends to stabilize some time after the change in the trim angle has stopped (see FIG. 9(*a*)–9(*d*)). Therefore, to take this into account the corrected fuel injection volume is set so that it diminishes toward a temporary basic fuel injection volume (with a correction value of 0). This is referred to as tailing. Referring to FIG. 7, there is shown an example of a correction map for the magnitude of change in the trim angle and tailing time. Referring to FIG. 8, there is shown a drawing indicating the relationship between the direction and magnitude of the change in the trim angle and the tailing time (correction continuation time). Referring again to FIG. 8, when the change in the trim angle is great, the time it takes for the fuel correction value to approach zero is longer than when the change in the trim angle is small.

As described above, during low-speed operation of engine 1, the trim angle is detected. Based on this trim angle and the state of engine 1, e.g. the engine rotation speed, the engine temperature, the intake air temperature, and the like, the residual fuel volume within engine 1 is estimated. The correction value determined from this estimated value is used in the injection of fuel. This prevents the fuel injection volume during low-speed operation of engine 1 from being too concentrated or too diluted, and provides an optimal air-to-fuel ratio.

Referring to FIG. 8, when the trim is increased, insufficient fuel is introduced into combustion chamber 24, resulting in a lean air-to-fuel ratio. Thus, the fuel correction value is positive (+). When the trim is decreased, the residual fuel left in engine 1 flows in all at once into combustion chamber 24, resulting in excess fuel and a richer air-to-fuel ratio. Thus, the fuel correction value is negative (−).

As described above, when engine 1 is operated at a low speed, the trim angle is detected. The magnitude of the change in the trim angle, the direction of the change in the trim angle, and the states of engine 1, e.g. the engine rotation speed, the engine temperature, the intake air temperature, and the like, are used to estimate the residual fuel volume within engine 1. This estimated value is used to determine a correction value which is applied to the volume of fuel injected. During low-speed operations, this prevents the fuel injection volume in engine 1 from becoming too rich or too lean, thus providing an optimal air-to-fuel ratio.

Also, the air-to-fuel ratio can be further optimized by setting the correction applied after a change in the trim angle is completed so that the fuel injection volume diminishes toward a temporary basic fuel injection volume.

Referring to FIG. 4, there is no need to prepare a special detecting means for fuel injection control device 41. The effects described above can be achieved by using existing sensors 23, 30, 47, 48, 49 and simply changing the program for microcomputer 44. Thus, no added costs are incurred. Furthermore, cost increases are also avoided since there is no need to change the layout of engine 1 to accommodate the attachment of new detecting means.

In the above embodiment, the estimated value for residual fuel volume is based on the rotation speed of engine 1, the temperature of engine 1, and the intake air temperature. However, other data sources can be used as well, such as the setting of throttle 28, the boost pressure of engine 1, the temperature of the cooling water for engine 1, the intake air volume, and the like.

Furthermore, the basic fuel correction volume is varied according to the direction of change in the trim angle. This provides an air-to-fuel ratio that is optimized for the direction in which the trim of the outboard device is changed.

Having described the preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims. It is to be further understood that although the embodiments described herein utilize a digital controller, one skilled in the art can easily use an analog control circuit or a hybrid analog-digital circuit to achieve the same effect without departing from the scope or the spirit of the invention as defined in the appended claims. It is to be further understood that although the particular embodiment described above may use a calculation of certain variables as an intermediate step in the program controlling the digital controller, and may, if necessary, store the value of these variables in its memory, the same result could be achieved without these intermediate steps of storage of variables through programming techniques well known in the art. It is to be further understood that the sensors of engine state discussed above are not limited to any particular type of sensor and may include any of a number of methods of sensing temperature, pressure, angle and rotational speed, including but not limited to mechanical means, electro-mechanical means, electrical or electronic means, solid state means, optical or opto-electric means, piezo-electric means, and the like. It is to be further understood that although the particular embodiments described above contemplate a direct sensing and measurement of certain physical parameters, including but not limited to temperature, pressure speed and trim angle, other indirect methods of deriving these parameters from other parameters may also be used without departing from the scope or spirit of the invention as described in the appended claims. It is to be further understood that although the embodiments described above contemplate sensing the trim angle of the engine, and then deriving the change in that angle, one skilled in the art can also use a detector of the change of the trim angle, and then derive the trim angle itself from that change in the angle without departing from the scope or spirit of the invention as described in the appended claims. It is to be further understood that although the particular embodiments described above contemplate an electrical connection between the sensors and the controller, the same result could be achieved by using a mechanical or optical signal transfer means without departing from the scope or the spirit of the invention as described in the appended claims. It is to be further understood that although the primary application contemplated by the embodiments described above is for two cycle engines for small marine vessels, one skilled in the art could readily apply the same invention to other fields, such as control of four cycle engines, or control of airborne engines, or the like, without departing from the scope or spirit of the invention as described in the appended claims.

What is claimed is:

1. A fuel injection control device for an outboard motor with a fuel-injected engine comprising:

a main control unit;

an engine state detector connected to apply an engine state signal to said main control unit;

said engine state detector includes at least one of an engine speed detector, a throttle setting detector, an engine boost pressure detector, an engine temperature detector, an engine cooling water temperature detector, a negative pressure intake detector, an air volume intake detector, and an intake air temperature detector;

a trim angle detector connected to detect a trim angle of said outboard motor;

said trim angle detector being connected to apply a trim angle detection signal to said main control unit;

said main control unit being programmed to control delivery of fuel to said fuel injected engine responsively to a change in said trim angle detection signal and at least one of said engine state signal and said trim angle detection signal;

said main control unit being further programmed to calculate a basic flow parameter corresponding to a basic fuel injection volume responsively to said trim angle detection signal and said engine state signal;

said main control unit being further programmed to calculate a residuum parameter corresponding to a residual fuel volume within said fuel injected engine responsively to said change in said trim angle detection signal, and control delivery of fuel to said fuel injected engine responsively to said residuum parameter; and said main control unit being further programmed to calculate a correction parameter corresponding to a corrected fuel injection volume responsively to said basic flow parameter and said residuum parameter and control delivery of fuel to said fuel injected engine responsively to said correction parameter.

2. A fuel injection control device for an outboard motor with a fuel-injected engine comprising:

a main control unit;

an engine state detector connected to apply an engine state signal to said main control unit;

a trim angle detector connected to detect a trim angle of said outboard motor;

said trim angle detector being connected to apply a trim angle detection signal to said main control unit;

said main control unit being programmed to control delivery of fuel to said fuel injected engine responsively to a change in said trim angle detection signal and at least one of said engine state signal and said trim angle detection signal;

said main control unit being further programmed to calculate a residuum parameter corresponding to a residual fuel volume within said fuel injected engine responsively to said change in said trim angle detection signal, and control delivery of fuel to said fuel injected engine responsively to said residuum parameter;

said main control unit being further programmed to calculate a basic flow parameter corresponding to a basic fuel injection volume responsively to said trim angle detection signal and said engine state signal;

said main control unit being further programmed to calculate a correction parameter corresponding to a corrected fuel injection volume responsively to said basic flow parameter and said residuum parameter and control delivery of fuel to said fuel injected engine responsively to said correction parameter; and said main control unit being programmed to so control said fuel injected engine only when said fuel injected engine is operating in a low speed mode, said low speed mode corresponding to an engine speed of said fuel injected engine that is substantially slower than an engine speed of said fuel injected engine operating in a high speed mode.

3. A fuel injection control device for an outboard motor with a fuel-injected engine comprising:

a main control unit;

an engine state detector connected to apply an engine state signal to said main control unit;

said engine state detector includes at least one of an engine speed detector, a throttle setting detector, an engine boost pressure detector, an engine temperature detector, an engine cooling water temperature detector, a negative pressure intake detector, a cooling water temperature detector, an air volume intake detector, and an intake air temperature detector;

a trim angle detector connected to detect a trim angle of said outboard motor;

said trim angle detector being connected to apply a trim angle detection signal to said main control unit;

said main control unit being programmed to control delivery of fuel to said fuel injected engine responsive to a change in said trim angle detection signal and at least one of said engine state signal and said trim angle detection signal;

said main control unit being further programmed to calculate a residuum parameter corresponding to a residual fuel volume within said fuel injected engine responsive to said change in said trim angle detection signal, and control delivery of fuel to said fuel injected engine responsively to said residuum parameter;

said main control unit being further programmed to calculate a basic flow parameter corresponding to a basic fuel injection volume responsively to said trim angle detection signal and said engine state signal; and said main control unit being further programmed to calculate a correction parameter corresponding to a corrected fuel injection volume responsively to said basic flow parameter and said residuum parameter and control delivery of fuel to said fuel injected engine responsively to said correction parameter.

4. A fuel control device for a motor comprising:

an engine state detector for producing an engine state signal;

said engine state detector detecting at least one of engine temperature, intake temperature, engine speed, engine boost pressure, throttle setting, engine cooling water temperature, intake air temperature, negative intake pressure, and intake air volume;

a trim angle detector detecting at least one of a trim angle and a change in said trim angle of said motor;

first means for computing a residual fuel correction value based on said trim angle and at least one of said engine speed, said engine temperature, and said intake temperature;

second means for computing a basic fuel injection volume based on said engine state signal; and means for adjusting said basic fuel injection volume in response to said residual fuel correction value.

5. A fuel device for a motor comprising:

an engine state detector for producing an engine state signal;

said engine state detector detecting at least one of engine temperature, intake temperature, engine speed, engine boost pressure, throttle setting, engine cooling water temperature, intake air temperature, negative intake pressure, and intake air volume;

a trim angle detector detecting at least one of a trim angle and a change in said trim angle of said motor;

first means for computing a residual fuel correction value based on said trim angle and at least one of said engine speed, said engine temperature, and said intake temperature;

second means for computing a basic fuel injection volume based on said engine state signal; and means for adjusting said basic fuel injection volume in response to said residual fuel correction value;

wherein said first means for computing is further programmed so that said residual fuel correction value is further based upon said change in said trim angle.

6. A fuel control device for a motor comprising:

an engine state detector for producing an engine state signal;

said engine state detector detecting at least one of engine temperature, intake temperature, engine speed, engine boost pressure, throttle setting, engine cooling water temperature, intake air temperature, negative intake pressure, and intake air volume;

a trim angle detector detecting at least one of a trim angle and a change in said trim angle of said motor;

first means for computing a residual fuel correction value based on said trim angle and at least one of said engine speed, said engine temperature, and said intake temperature;

second means for computing a basic fuel injection volume based on said engine state signal; and means for adjusting said basic fuel injection volume in response to said residual fuel correction value;

wherein said first means for computing is programmed so that said residual fuel correction value decreases over time.

7. A fuel control device for a motor as in claim 6 wherein said first means for computing is programmed so that said residual fuel correction value decreases over time quicker when said trim angle corresponds to a movement of said motor in a first direction than when said trim angle corresponds to a movement of said motor in a second direction.

* * * * *